US009303303B2

(12) United States Patent
Meyer et al.

(10) Patent No.: US 9,303,303 B2
(45) Date of Patent: Apr. 5, 2016

(54) PROCESS FOR THE HEAT TREATMENT OF CYLINDER HEADS MADE OF AN ALUMINIUM-BASED ALLOY, AND CYLINDER HEADS HAVING IMPROVED FATIGUE RESISTANCE PROPERTIES

(75) Inventors: Philippe Meyer, Agnetz (FR); Denis Massinon, Liancourt (FR); Julien Morichon, Bussy les Daours (FR)

(73) Assignee: Montupet S.A. (FR)

( * ) Notice: Subject to any disclaimer, the term of this patent is extended or adjusted under 35 U.S.C. 154(b) by 1095 days.

(21) Appl. No.: 12/666,023

(22) PCT Filed: Jun. 19, 2008

(86) PCT No.: PCT/EP2008/057811

§ 371 (c)(1), (2), (4) Date: Oct. 4, 2010

(87) PCT Pub. No.: WO2009/000749

PCT Pub. Date: Dec. 31, 2008

(65) Prior Publication Data

US 2011/0011501 A1 Jan. 20, 2011

(30) Foreign Application Priority Data

Jun. 22, 2007 (FR) ..... 07 55973

(51) Int. Cl.
*C22F 1/04* (2006.01)
*C22F 1/05* (2006.01)
(Continued)

(52) U.S. Cl.
CPC . *C22F 1/05* (2013.01); *C22C 21/02* (2013.01); *C22F 1/043* (2013.01)

(58) Field of Classification Search
USPC ..... 148/439, 440, 700, 702
See application file for complete search history.

(56) References Cited

U.S. PATENT DOCUMENTS 5,052,923 A 10/1991 Peter et al.
5,624,255 A 4/1997 Hisada et al.
(Continued)

FOREIGN PATENT DOCUMENTS

DE 29603022 U1 4/1996
DE 19858582 A1 6/2000
(Continued)

OTHER PUBLICATIONS

Li et al. "Parameters controlling the performance of AA319-type alloys Part I. Tensile properties." Materials Science and Engineering A 367 (2004) 96-110. Jun. 23, 2003.*
(Continued)

*Primary Examiner* — Kaj K Olsen
*Assistant Examiner* — Alexander Polyansky
(74) *Attorney, Agent, or Firm* — Lerner, David, Littenberg, Krumholz & Mentlik, LLP

(57) ABSTRACT

The invention relates, according to a first aspect, to a process for the heat treatment of a cylinder head-type casting made from an aluminum alloy, in particular an alloy of aluminum, of silicon and of magnesium, and where appropriate of copper, comprising the steps of: —solution annealing (L) of the part for a time between three and ten hours; —quenching (S) of the part in air or in a fluidized bed; —tempering (H) of the part at the peak of resistance, or in the vicinity of the peak of resistance to attain a level of resistance of the part at least equal to 85% of the maximum level of resistance at the tempering temperature in question. According to a second aspect, the invention relates to the castings obtained at the end of the process according to the invention, and which have an improved fatigue resistance.

18 Claims, 3 Drawing Sheets

(51) Int. Cl.

| | |
|---|---|
| ***C22C 21/02*** | (2006.01) |
| ***C22F 1/043*** | (2006.01) |
| *C22C 21/06* | (2006.01) |
| *C22C 21/12* | (2006.01) |

(56) References Cited

U.S. PATENT DOCUMENTS

| | | | | |
|---|---|---|---|---|
| 6,451,137 | B1 | 9/2002 | Pelissier | |
| 6,571,615 | B1 | 6/2003 | Meyer et al. | |
| 6,752,885 | B1 | 6/2004 | Jerichow | |
| 7,255,829 | B1 | 8/2007 | Peter et al. | |
| 2004/0265163 | A1 | 12/2004 | Doty | |
| 2005/0076977 | A1* | 4/2005 | Lumley et al. | 148/698 |
| 2007/0051336 | A1 | 3/2007 | Barth et al. | |
| 2008/0060723 | A1* | 3/2008 | Doty | 148/549 |

FOREIGN PATENT DOCUMENTS

| | | | |
|---|---|---|---|
| DE | 19956895 | C1 | 11/2000 |
| DE | 10117987 | A1 | 10/2002 |
| EP | 0422353 | A2 | 4/1991 |
| EP | 1090278 | | 4/2001 |
| EP | 1154024 | A1 | 11/2001 |
| EP | 1469089 | A1 | 10/2004 |
| EP | 1531185 | A1 | 5/2005 |
| GB | 2361710 | A | 10/2001 |
| WO | 2005/093114 | A1 | 10/2005 |

OTHER PUBLICATIONS

International Search Report, PCT/EP2008/057811, dated Aug. 21, 2008.

International Search Report, PCT/EP2008/057813, dated Oct. 13, 2008.

* cited by examiner

PROCESS FOR THE HEAT TREATMENT OF CYLINDER HEADS MADE OF AN ALUMINIUM-BASED ALLOY, AND CYLINDER HEADS HAVING IMPROVED FATIGUE RESISTANCE PROPERTIES

CROSS-REFERENCE TO RELATED APPLICATIONS

The present application is a national phase entry under 35 U.S.C. §371 of International Application No. PCT/EP2008/057811 filed Jun. 19, 2008, which claims priority from French Patent Application No. 0755973, filed Jun. 22, 2007, all of which are incorporated herein by reference.

BACKGROUND

The field of the invention is that of heat treatments of castings made in an alloy based on aluminium.

The invention more specifically relates to a method for the heat treatment of cylinder heads molded in aluminium alloys and to the cylinder heads resulting from such a method.

Cylinder heads molded in aluminium alloys are in vast majority used in performing automobile engines.

The increase in the specific powers of these engines, and the search for better performances as regards polluting emissions leading to increased pressure on the material of the cylinder head, one skilled in the art conventionally uses structurally hardened casting alloys.

Aluminium casting alloys include different families of composition, most of which are capable of structural hardening by heat treatment. In particular, mention may be made of the aluminium/silicon/magnesium family and of the aluminium/silicon/copper/magnesium family.

Notably, for making automobile components in mass production, for example cylinder heads subject to very strong loads upon use, one skilled in the art notably uses:

alloys of the A319 type according to the designation of the Aluminium Association, comprising from 5.0% to 9.0% of silicon, from 2.0% to 3.5% of copper, from 0.2 to 0.6% of magnesium, alloys of the A356 or A357 type according to the designation of the Aluminium Association, comprising from 6.5% to 7.5% of silicon, from 0.2 to 0.7% of magnesium, or even intermediate alloys or alloys close to both of these families.

In particular, alloys of the A356 type further comprising 0.56% copper are frequently used for heavy duty diesel engine cylinder heads.

In order to maximize the mechanical properties of these alloys, it is customary use, at least for the cases of the most severe loads, to achieve full heat treatment associating in this order:

high temperature solution heat treatment, typically between 490° C. and 550° C.;

water quenching between the solutionization temperature and the water quenching temperature (typically between 20° C. and 95° C.; boiling water may also be used);

cooling in the surroundings of the workshop before a tempering treatment for hardening at temperatures of the order of 120° C. to 250° C.

The above treatments are typically carried out over dwelling times of the order of 5 to 6 hours at a temperature in the oven, the rise in temperature of the load usually being of the order of 1 to 2 hours for cylinder heads.

However, these practices for parts with a geometry as complex as that of cylinder heads lead during the quenching to the generation of significant residual stresses which may locally reach the cold elastic limit level of the material.

Increasing the temperature of the quenching water is a well-known means to one skilled in the art for reducing these residual stresses.

However, the use of boiling water does not allow complete suppression of these residual stresses. Further, quenching with boiling water leads to significant reductions in mechanical characteristics.

One skilled in the art partly finds a remedy to the persistence of residual stresses after quenching by practicing hardening tempering operations at high temperatures, typically beyond 200° C., leading in this way the alloy to an over-tempering state (transition to beyond the maximum strength peak). These types of treatments are commonly called T7 treatments.

It has also been proposed to reduce the time required for achieving the whole of the heat treatment (solutionization, quenching and tempering). Document GB 2,361,710 thus proposes to limit the duration of solutionization to a maximum of three hours, and preferably to a maximum of two hours. The treatment recommended by this document, for a shorter treatment time, results in mechanical characteristics similar to those of the T7 treatment.

It will be noted that this document GB 2,361,710 specifies that the fatigue properties are only very slightly influenced by the type of heat treatment and indicates that owing to this, the fatigue properties of parts subject to the T7 treatment or to the treatment according to this document GB 2,361,710 with shorter solutionization should not be significantly different.

Document U.S. Pat. No. 6,752,885 also provides a shorter heat treatment than the T7 treatment, this treatment comprising solutionization for a duration comprised between one hour thirty minutes and two hours and tempering at a temperature of 250° C.

The applicant has also developed and has been commercially using for many years a treatment of the T5 type consisting of the following sequence:

fast solidification inside the mold, generally a metal mold, at least for the portion molding the fire face of the cylinder head, fast cooling with forced air after ejecting the part out of the mold, the part then being still provided with its inner sand cores and with its feeder heads, down to room temperature, the whole being followed by hardening tempering.

This treatment has the advantage of suppressing residual stresses, but with it, it is not possible to draw the whole benefit from the hardening potential of the alloy.

BRIEF SUMMARY

The present invention aims at overcoming these drawbacks and allowing reduction of the residual stresses of the alloy, while better utilizing the hardening potential of the alloy in order to maximize the functional performances of the cylinder head, notably the hot-cold fatigue strength which is the most severe test for developing load-ridden cylinder heads.

For this purpose and according to a first aspect, it proposes a method for heat treatment of a casting part of the cylinder head type made in an aluminium alloy, notably in an alloy of aluminium, silicon and magnesium, and optionally copper, characterized in that it comprises the following steps:

solutionizing the part for a duration comprised between three and ten hours;

quenching the part with air or in a fluidized bed;

tempering the parts at the resistance peak or in proximity to the resistance peak in order to achieve a resistance level of the part at least equal to 85% of the maximum resistance level at the relevant tempering temperature.

Certain preferred, but non-limiting aspects of this method are the following:

solutionization is performed for a duration comprised between five hours and ten hours;

solutionization is performed at a temperature comprised between 490° C. and 550° C.;

solutionization is carried out in a conventional oven;

solutionization is carried out in a fluidized bed;

solutionization comprises:

solutionization in a fluidized bed for a duration of less than or equal to 30 minutes, applied upon exiting molding so as to clean the part, complementary solutionization in a conventional oven.

solutionization is applied to the part after suitable complete cleaning for ridding the part of its internal cores, and after removal of the feeder heads and of the casting systems;

solutionization is applied to the part upon exiting molding;

cooling of the part during the quenching is performed according to a cooling curve located under the cooling curve SUP of FIG. 1, and preferably under the cooling curve INF of FIG. 1;

quenching is carried out in a fluidized bed at a temperature of less than 40° C.;

quenching is air quenching at room temperature of parts positioned in a single layer crossed by the air flow;

the air flow rates are greater than 1,000 $m^3$/h/part and preferably greater than or equal to 1,700 $m^3$/h/part;

tempering is achieved at the maximum resistance peak for the relevant tempering temperature;

tempering is performed in a conventional oven;

tempering is performed in a fluidized bed;

the alloy is of the AA 319 type and tempering is performed at 230° C. for 1 h 30 min in a fluidized bed, or at 210° C. for 4 hours in a conventional oven;

the alloy is of the AA 356 type and tempering is performed at 180° C. for 5 hours in a conventional oven;

the part is a cylinder head.

According to a second aspect, the invention proposes a cylinder head made in an aluminium-based alloy, notably in an alloy of aluminium, silicon, magnesium, and optionally copper, characterized in that it has a fatigue resistance evaluated by the "hot-cold" fatigue resistance test, and expressed as a number of cycles before fatigue breaking to within +/−200 cycles, greater than 4,800 cycles, preferably close to 9,500 cycles.

BRIEF DESCRIPTION OF THE SEVERAL VIEWS OF THE DRAWINGS

Other aspects, objects and advantages of the present invention will become better apparent upon reading the following detailed description of preferred embodiments thereof, given as a non-limiting example and made with reference to the appended drawings wherein.

DETAILED DESCRIPTION

Figure 1:
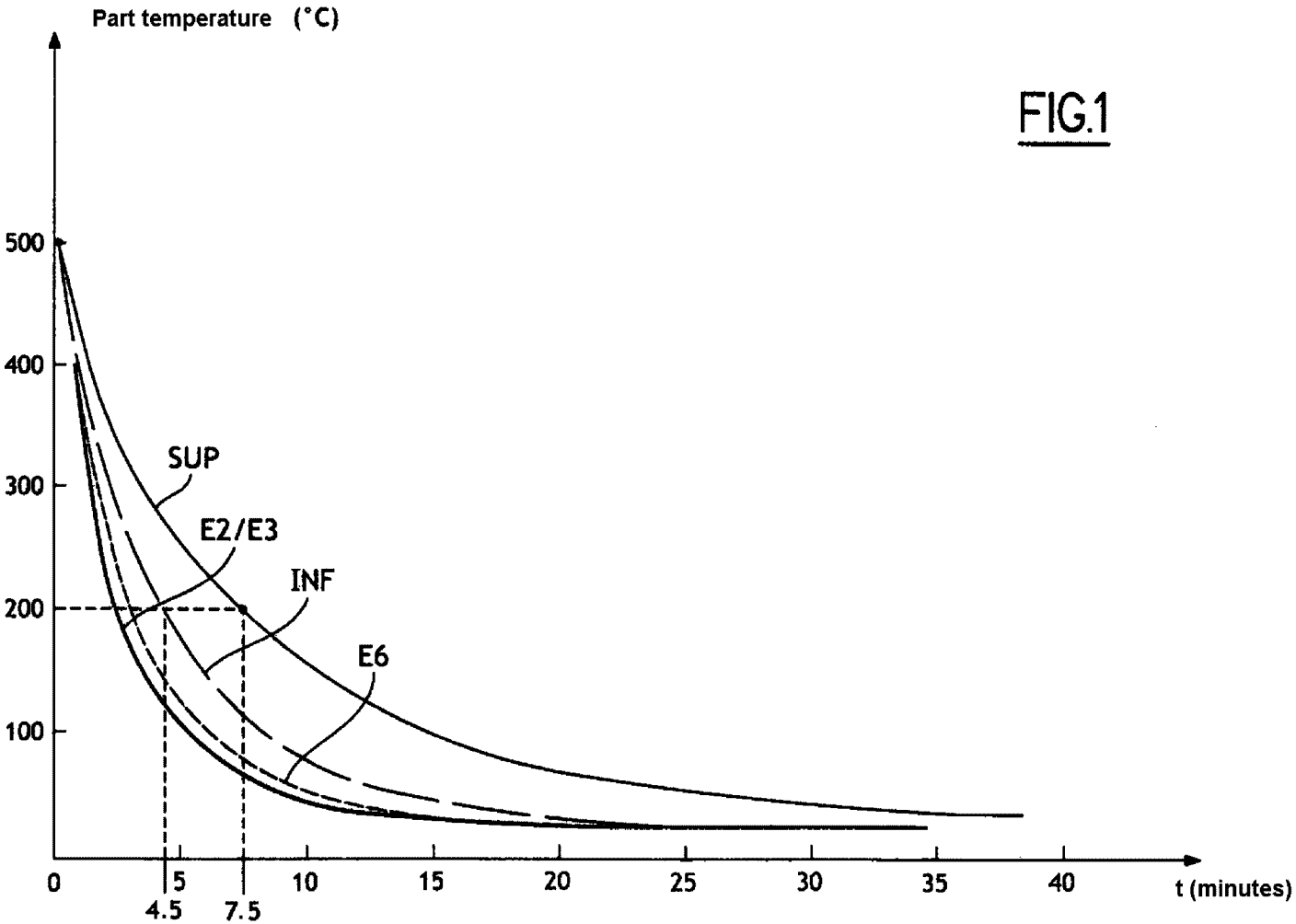
FIG. 1 illustrates cooling curves under which quenching according to the invention should be performed, as well as cooling curves applied to cylinder heads during quenching according to exemplary embodiments of the invention.

The invention applies to aluminium casting alloys with structural hardening regardless of their chemical composition, and to parts made from these materials.

The invention in particular relates to castings made in an aluminium-based alloy, notably in an alloy of aluminium, silicon, magnesium, and optionally copper.

The invention more particularly finds application in the heat treatment of automobile components cast in such aluminium-based alloys, and subject to heavy duty use.

The invention in particular proves to be particularly advantageous for cylinder heads of automobile engines which, as this has been seen earlier, are strongly load-ridden castings. The example of such cylinder heads will be taken in the subsequent description.

The method according to the invention comprises the steps consisting of submitting the cylinder head:

to a solutionization treatment at usual temperatures for solutionization, but for a longer duration, to quenching in air or in a fluidized bed, not generating any residual stresses, to "hard" tempering at the hardness peak of the alloy.

Solutionization

Solutionization may be carried out in an oven with a fluidized bed, or in a conventional oven, or even in a succession of both.

Solutionization is performed at the usual temperature for solutionizing the alloy.

Solutionization is performed for a duration comprised between 3 hours and 10 hours. According to an advantageous alternative of the invention, solutionization is performed for a duration comprised between 5 hours to 10 hours, including treatments in the fluidized bed.

It will be understood that, when solutionization successively comprises solutionization in a fluidized bed (for example short quenching in a fluidized bed, for a duration of less than or equal to 30 minutes), and complementary solutionization in a conventional oven, the duration of the complementary solutionization is then adapted so as to reach a total duration comprised between 3 hours and 10 hours according to the invention.

It will be noted that the invention goes against the trends of the art, notably illustrated by documents GB 2,361,710 and U.S. Pat. No. 6,752,885 which recommend reduction in the duration of full heat treatment, notably via reduction in the solutionization duration.

The applicant was able to ascertain that unlike what is indicated by the static mechanical properties (hardness, specimen traction, for example), it proves to be of interest to increase the duration of solutionization as regards the functional properties of the cylinder heads (and this even when this solutionization is carried out in a fluidized bed).

According to an alternative embodiment of the invention, solutionization is applied to the cylinder head after complete cleaning which rids it of all its internal cores, notably by mechanical means (hammering and vibration typically), and after removal of the feeder heads and of the casting systems, which allows maximization of the cooling rate upon quenching.

Alternatively, solutionization may be performed on parts upon exiting molding; by performing solutionization in a fluidized bed it is notably possible to efficiently clean the cylinder head. However, the cylinder head further includes its feeder heads, or even its casting system during quenching, which is not optimum as this has just been noted.

Quenching

After solutionization, the cylinder head is subject to quenching which is not carried out in water but in air or in a fluidized bed.

Temperature vs. time curves are illustrated in FIG. 1 representing the time course of the temperature during the quenching of the cylinder head in the most critical temperature domain, i.e. between 500° C. and room temperature.

Within the scope of the invention, the quenching cooling rate is adapted so that cooling, as measured by one or more thermocouples positioned in the cylinder head, is located under the curve SUP illustrated in FIG. 1, and preferably under the curve INF, illustrated in FIG. 1.

Such a cooling rate according to the invention in particular implies that the temperature of the cylinder head in the most critical areas from a functional point of view, i.e. the fire face, passes from 495° C. to 200° C. in less than 7 min 30 s (SUP curve), and preferably in less than 4 min 30 s (INF curve).

Such a cooling rate may be obtained by quenching the cylinder head in a fluidized bed formed by a biphasic mixture of particles, for example a mixture of siliceous sand and air, which allows high quenching rates.

The temperature of the fluidized bed is less than 40° C., for example has a value of 30° C.

Thanks to the unique physical properties of this quenching medium, notably its good heat conductivity, the level of residual stresses after the quenching operation is practically negligible.

Such quenching treatments in a fluidized bed are presently available on the market, just as they are for solutionization.

A possible alternative to the quenching treatment in a fluidized bed described above consists of performing air quenching.

One skilled in the art rarely uses air quenching for the heat treatment of automobile cylinder heads although it is expressed by quasi-absence of residual stresses. Indeed, applying this technique often results in excessive reduction of the characteristics of the material.

The applicant however has developed a method which allows, under the conditions described by the invention, quenching rates almost equivalent to those recorded for the fluidized bed, and such that the cooling curve of the cylinder head during the air quenching is also located under the SUP curve, preferably under the INF curve illustrated in FIG. 1.

Thus, according to original work conducted by the applicant, and in a quite surprising way, a high cooling rate may also be attained with air quenching, when air quenching is performed at room temperature for parts positioned vertically or horizontally in a single layer. The parts of this single layer are separated from each other by a distance of the order of 30 mm (with separators between the parts not included in this distance) and crossed by a cooling air flow. The air flow rates to be considered for the cooling air flow are preferably greater than 1,000 $m^3$/h and per cylinder head and preferably greater or equal to 1,700 $m^3$/h and per cylinder head. The air is at room temperature. As examples, the air velocity is of the order of 23 m/s for a flow rate of 1,000 $m^3$/h and per cylinder head, and of the order of 45 m/s for a flow rate of 1,700 $m^3$/h and per cylinder head.

Tempering

In both cases (quenching in a fluidized bed, quenching in air), the residual stresses are minimized as compared with water quenching (and this regardless of the temperature of the quenching water). With this minimization of residual stresses, it is possible to do without any high temperature over-tempering (of the T7 type) which one skilled in the art generally applies to the cylinder heads after quenching in order to release the residual stresses, but which is expressed by a reduction in the mechanical characteristics relatively to the maximum hardness.

By doing this, within the scope of the invention, it is possible to apply to the cylinder head, "hard" tempering close to the resistance peak, which allows maximization of the mechanical characteristics of the material, notably the elastic limit and breaking load.

The determination of the resistance peak may be accomplished experimentally and conventionally, for example by first selecting the tempering temperature to be considered, and then by submitting parts which are solutionized and quenched beforehand to variable tempering durations at this tempering temperature. These parts are then characterized e.g. by taking tensile test specimens in the critical functional areas of the cylinder head, for example the fire face. The resistance peak is defined by characterizing the different tensile test specimens, and then by plotting the "mechanical tensile strength versus the tempering duration" curve, for the relevant tempering temperature. The resistance peak is defined as the maximum of this curve.

The tempering duration giving the alloy its maximum mechanical characteristics, associated with the relevant tempering temperature, thus forms the tempering conditions at the resistance peak.

This resistance peak may also be determined by using hardness tests instead of tensile tests, but the technique using tensile test specimens is more accurate and is therefore recommended by the applicant.

According to a preferential embodiment of the invention, hard tempering is applied at the peak, according to which the alloy is brought to the resistance peak determined according to the method described beforehand. Thus, for this given tempering temperature, the state commonly designated by "T6" is obtained for aluminium alloys, corresponding to the resistance peak of the alloy for this given temperature.

Alternatively, tempering is performed in proximity to the peak, according to which the alloy is subject to suitable tempering in order to obtain a tensile strength level at least equal to 85%, preferably at least equal to 90%, further preferably at least equal to 95%, of the maximum strength level at the relevant tempering temperature.

Tempering according to the invention is therefore performed according to a suitable temperature/duration pair in order to reach or at the very least approach, the highest possible T6 state after air quenching or quenching in a fluidized bed according to the temperature vs. time curves described by the applicant, and corresponding to the maximum resistance of the alloy, according to the method which has just been detailed.

As examples, and as this will be detailed subsequently, hard tempering according to the invention may be performed by maintaining a temperature of 240° C. for 1 h 30 s for an AA 319 type alloy in a tempering treatment in a fluidized bed, or else by maintaining a temperature of 180° C. for 5 h for an AA 356 type alloy in a tempering treatment in a conventional oven.

Applying the method according to the invention results in quite exceptional lifetime performances of the cylinder head, as measured on a complete cylinder head in a so-called "hot-cold" fatigue test of the type described in patent application EP 1 090 278 of the applicant. It will be noted that this test has the advantage of being perfectly correlated with the engine tests, while being accelerated for total test duration of the order of 1 to 2 weeks.

Experiments

Experiment No. 1

In all the examples below, five in-line cylinder diesel engine cylinder heads were cast under static gravity in a metal mold, fire face facing downwards, with a steel sole drastically cooled so as to obtain a very fine micro-structure which may be characterized by the measurement of the SDAS (Secondary Dendrite Arm Spacing), with values of the order of 23 microns in the area where the tensile test specimens are taken, used for characterizing the material.

The cast metal temperature is from 710 to 715° C. upon arriving in the pouring bush of the mold, from which feeding channels leave in order to fill the mold through gates located at the bottom of the part.

The yield, the ratio between the cast weight (part plus feeding system, plus feeder heads) and the weight of the part, is 1.66. The molded casting weighs 18.6 kg.

The whole core making is achieved in a method of the "cold box" type, for making inner shapes: admission, exhaust pipes, pipes for circulation of water, oil and for making the core containing the feeder heads, a reserve of metal located above the part itself and providing the feeding of liquid metal during solidification and contraction of the part.

The molding cycle time is of the order of 6 minutes from one part to the next.

The alloy is of the AA 319 type, a secondary alloy selected with a chemical composition given hereafter in weight percentages:

| Si | Cu | Fe | Mn | Mg | Ti | Zn | Al |
|---|---|---|---|---|---|---|---|
| 6.87 | 3.10 | 0.45 | 0.20 | 0.21 | 0.14 | 0.20 | balance |

The alloy has its eutectic structure modified by adding strontium.

The bench test was conducted under conditions with which the thermal loads of a severe hot-cold test may be reproduced on an engine bench, the cylinder head being attached by its fixing screws on a steel plate replacing the engine block, and provided with bores reproducing the bores of the cylinders of the engine.

Gas burners are housed in these bores. The cylinder head is mounted with open exhaust valves and closed intake valves.

The hot cycle consists of heating the combustion face by means of gas burners, the coolant liquid flowing through the water circuit, so that the temperature in the inter-valve bridges between the valves reaches the value of 250° C.

The cold cycle consists of interrupting the heating of the combustion face, the coolant liquid still flowing through the water circuit, so that the temperature in the inter-valve bridges reaches the value of 40° C.

The temperature of the inter-valve bridges is measured at 1 mm from the fire face surface in a cylinder head identical with that of the T5 state (Test no. 1) and provided with thermocouples, this in order to carry out the adjustments of the burners and of the coolant liquid flow rates allowing these temperatures to be reached.

The hot cycle duration is 40 seconds; that of the cold cycle 25 seconds, which gives a total unit cycle time of 65 seconds.

The test is regularly interrupted in order to examine the bridges on the combustion face side, in order to determine the crack initiation phase. Fatigue breaking is determined as soon as a bridge through-crack leading to a water leak in the water circuit towards the combustion face is observed.

These experimental conditions of a fatigue breaking test were first applied to the cylinder heads treated in the T5 state (Test no. 1). They were then reproduced under the same conditions of heating power, cooling power and cycling to cylinder heads submitted to other heat treatments (Tests nos. 2 and 3).

The cylinder heads were also subject to tensile and hardness characterization at room temperature.

The tensile properties are measured according to the AFNOR EN 10002-1 standard in the fire face with tensile test specimens of diameter 6.18 mm with a calibrated length of 36.2 mm. Each measurement is the average measurement of 5 specimens per part, for 3 parts.

Figure 2:
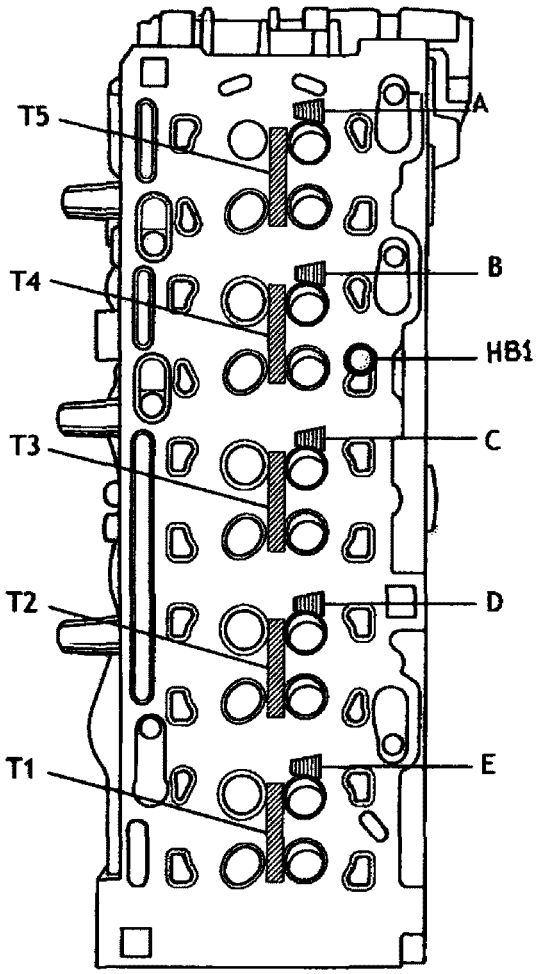
FIG. 2 is relative to the characterization of a cylinder head in traction and in hardness.

Brinell hardness is measured according to the AFNOR EN ISO 6506-1 and ASTM E10-06 standards in the fire face also. One measurement is conducted par part, for five parts. The areas T1-T5 where tensile test specimens were taken and the HB1 position for hardness measurements and the position A-E of micrographic examinations for measuring SDAS are illustrated in FIG. 2.

Test No. 1:

cylinder head submitted to the reference T5 treatment

After casting, the part was extracted from the mold and cooled in a forced air tunnel so that it is cooled down to a temperature of 50° C. within a period of the order of 60 minutes.

The cylinder head was then subject to usual finishing operations and then to tempering: 4 hours at 210° C. in a conventional tempering oven, and then complete machining before being subject to the bench test.

The result of the resistance test, expressed as a number of cycles before fatigue breaking, is 3,600 cycles (+/−200 cycles; repeated twice) for the cylinder head treated by the heat treatment T5.

Test No. 2

The test was conducted on a cylinder head having been subject to the following method.

After casting, the part was extracted from the mold and subject, after having got rid of its casting systems, to a heat treatment with the following parameters:

Solutionization for 2 hrs at 498° C. in a fluidized bed;

Quenching in a fluidized bed at 30° C. The cooling curve is compliant with the one bearing reference E2/E3 in FIG. 1 and located under the INF cooling curve. It will be noted in particular that according to this curve E2/E3, the duration for passing from 495° C. to 200° C. is of the order of 3 min 30 s, therefore less than 4 min 30 s;

Tempering for 4 hrs at 210° C. in a ventilated conventional oven, corresponding to the maximum resistance peak of the alloy.

The cylinder head was then subject to complete machining before subject to the bench test.

The result of the resistance test, expressed in the number of cycles before fatigue breaking is 4,800 cycles (+/−200 cycles; repeated twice) for the cylinder head treated according to Test no. 2.

Test No. 3:

The test was conducted on a cylinder head having been subject to the following process.

After casting, the part was extracted from the mold and after having got rid of its casing systems, subject to a heat treatment according to the invention with the following parameters:

Long solutionization: 8 h at 498° C. in a fluidized bed;

Quenching in a fluidized bed at 30° C. consisting of a biphasic mixture of air at room temperature and of siliceous sand with a grain size of 50 AFS, the whole fluidized in a quenching tank provided with cooling plates in which cold water flows, at 20-23° C. The cooling curve is compliant with the one bearing reference E2/E3 in FIG. 1, located under the INF cooling curve;

Tempering for 1 h 30 at 230° C. in a fluidized bed which corresponds to the resistance peak of the alloy at this tempering temperature.

The result of the resistance test, expressed as the number of cycles before fatigue breaking, is 9,500 cycles (+/−250 cycles; repeated twice) for the cylinder head treated according to Test no. 3.

Figure 4:
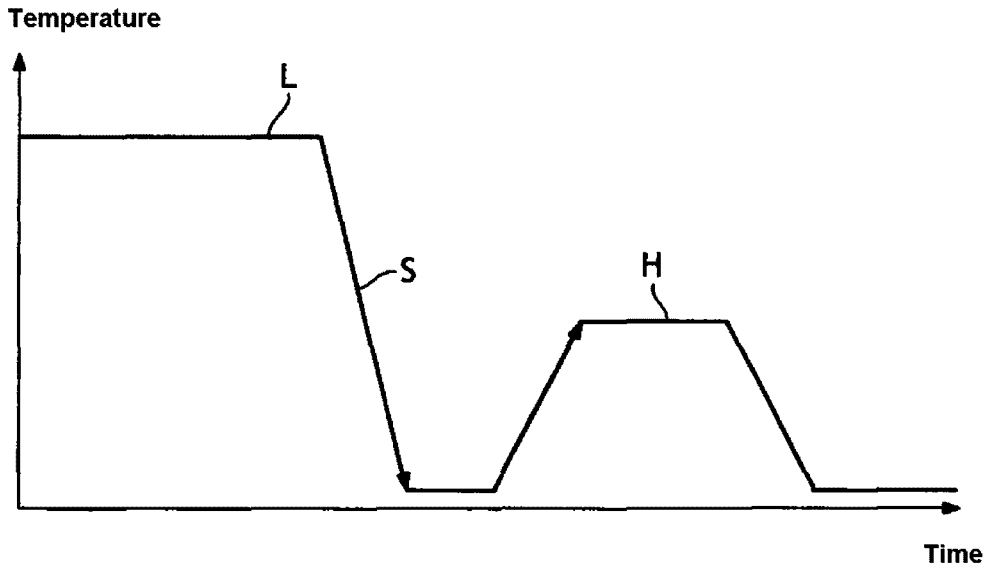
FIG. 4 is a temperature vs. time diagram illustrating schematically the heat treatment of the method according to the first aspect of the invention.

The whole of these results clearly show the benefit of associating, as illustrated schematically in the temperature vs. time diagram of FIG. 4, long solutionization L (L for Long), quenching not generating any residual stresses S (S for Soft), and hard tempering H (H for Hard).

It is also observed that the heat treatment according to the invention is clearly more performing than the T5 treatment as practiced by the applicant, this T5 treatment itself being more performing on engine tests than the conventional T7 type heat treatments for the relevant cylinder head.

The conventional T7 treatments consisting in solutionization for a period of the order of 5 hours at 495° C., in quenching in water at 70° C. typically, and tempering operations for a period of the order of 5 hours at 230° C. (over-tempering) have been characterized elsewhere by the applicant on similar cylinder heads. In particular, the publication "A Phenomenological Model for Fatigue Life Prediction of Highly Loaded Cylinder Heads" (SAE Technical Paper no. 2006-01-0542) shows that for certain highly loaded engine applications, type 319 alloys treated in the T5 state—although not reaching the maximum hardening potential of the alloy—may provide performances on cylinder heads being used, which are greater than those of alloys subject to complete T7 type heat treatments.

It will moreover be noted that the static mechanical characteristics on the cylinder heads of Tests nos. 1, 2 and 3 and referred to in the Table below, did not show any significant differences between the parts of Test no. 2 and those of Test no. 3. These parts are however very different in functional behavior on a bench (4,600 cycles before breaking for Test no. 2; 9,500 cycles before breaking for Test no. 3).

| Test | Breaking limit Rm (MPa) | Elastic limit $Rp_{02}$ (MPa) | Elongation $A_p$ (%) | Hardness $H_B$ |
|---|---|---|---|---|
| No. 1 | 280 | 218 | 1.7 | 101 |
| No. 2 | 346 | 282 | 1.9 | 107 |
| No. 3 | 349 | 281 | 1.9 | 107 |

The whole of these observations leads to the conclusion that with traction and hardness characterizations, the functional performances of the cylinder head on the bench cannot be predicted.

It is understood that as regards the static mechanical properties observed on these test specimen samples, there was nothing to hint that the heat treatments according to the invention of Test no. 3 may be able to obtain functional performances on the cylinder head upon use which are higher than those of Test no. 2.

These are results surprisingly observed by the applicant, when the latter formed a bench characterization of the complete fatigue resistance of cylinder heads.

Moreover, it will be noted that in the technical field of the invention, the general feeling is shared, according to which the duration of solutionization does not have any considerable impact on fatigue, if solutionization is applied. An encouragement to reduce the duration of solutionization ensues from this as this is for example described in document GB 2,361,710.

The applicant was however able to ascertain, even though the static mechanical characteristics (traction, hardness) are overall equivalent and there is therefore no incentive to conduct additional experiments, notably on the complete parts, and even though preconceived ideas in the field tended to lead the applicant away from the solution of the invention by recommending short solutionization, that, surprisingly, it was possible to end up with a strong increase in the functional performances of the cylinder head by applying the method according to the invention associating long solutionization, quenching which does not generate residual stresses, and hard tempering.

Experiment No. 2

In all the examples below, four in-line cylinder diesel engine cylinder heads were cast under static gravity in a metal mold, the fire face facing downwards, with a steel sole drastically cooled so as to obtain a fine micro-structure which may be characterized by measuring SDAS (Secondary Dendrite Arm Spacing), with values of the order of 30 microns in the area from which are taken the tensile test specimens being used for characterizing the material.

The metal temperature upon casting is 720° C. upon arriving in the pouring bush of the mold, from which leave feeding channels for filling the mold through gates located at the bottom of the part.

The yield, the ratio between the cast weight (part plus feeding system, plus feeder heads) and the weight of the part, is 1.7. The molded casting weighs 14.1 kg.

The entire core making is achieved in a method of the "cold box" type, for making inner shapes: admission, exhaust pipes, pipes for circulation of water, oil and for making the core containing the feeder heads, a reserve of metal located above the part itself and providing the feeding of liquid metal during solidification and contraction of the part.

The molding cycle time is of the order of 5 minutes from one part to the next.

The alloy is of the AA 356 type, a primary alloy, with a chemical composition given hereafter in weight percentages:

| Si | Fe | Mn | Mg | Ti | Zn | Al |
|---|---|---|---|---|---|---|
| 7.4 | 0.12 | 0.02 | 0.30 | 0.11 | 0.02 | balance |

The alloy has its eutectic structure changed by adding strontium.

After casting, the part was extracted from the mold and cooled in a forced air tunnel so that it is cooled down to a temperature of 50° C. within a time of the order of 120 minutes.

The cylinder heads were then submitted to usual finishing operations and then to:

Test No. 4:

The reference heat treatment comprising:

Solutionization for 6 h at 540° C. in a conventional oven

Quenching in hot water at 70° C.

Tempering for 6 h at 200° C. in a conventional oven.

Test No. 5:

A heat treatment out of the perimeter of the invention, applying water quenching, and comprising:

Solutionization for 6 h at 540° C. in a conventional oven

Quenching in water close to boiling at 93° C.

Tempering for 6 h at 200° C. in a conventional oven.

Test No. 6:

A heat treatment according to the invention, comprising:

Solutionization for 6 h at 540° C. in a conventional oven

Air quenching and operating conditions as discussed earlier, with a cooling curve compliant with the one bearing reference E6 in FIG. 1, located under the INF cooling curve. In particular it will be noted that according to this curve E6, the duration for passing from 495° C. to 200° C. is of the order of 4 min, therefore less than 4 min 30 s.

The air quenching of curve E6 corresponds to the quenching of cylinder heads positioned vertically and individually on a single layer, the cylinder heads being separated from each other by 30 mm (without counting the spacers), and placed in baskets crossed by an air flow having a flow rate of 3,000 $m^3$/h Tempering for 5 h at 180° C. in a conventional oven, corresponding to the peak of maximum resistance of the alloy. Tensile test specimens were taken in the cylinder heads of Tests nos. 4, 5 and 6, in a way similar to what was achieved within the framework of experiment 1, and the mechanical tensile characteristics were measured on these test specimens. Similarly to Example 1, hardness was also measured on the fire face of the cylinder heads.

These characteristics are reported in the following table

| Test | Breaking limit Pm (MPa) | Elastic limit $Rp_{02}$ (MPa) | Elongation $A_p$ (%) | Hardness $H_B$ |
|---|---|---|---|---|
| No. 4 | 283 | 245 | 6.7 | 97 |
| No. 5 | 271 | 233 | 6.2 | 95 |
| No. 6 | 290 | 238 | 4.4 | 106 |

It will be observed that the heat treatment according to the invention and applying long solutionization, air quenching and tempering in proximity to the resistance peak (Test no. 6) induces a set of mechanical properties comparable to those of the reference type T7 treatment carried out with water quenching at 70° C., at the expense of a slight reduction in the elongation characteristics as compared with the T7 treatment applying standard water quenching (Test no. 4) and gives results of mechanical characteristics above those obtained with the T7 treatment applying water quenching at a temperature close to the boiling point (Test no. 5).

The global levels of residual stresses were moreover characterized by the three Tests nos. 4, 5 and 6 in the following way.

Figure 3:
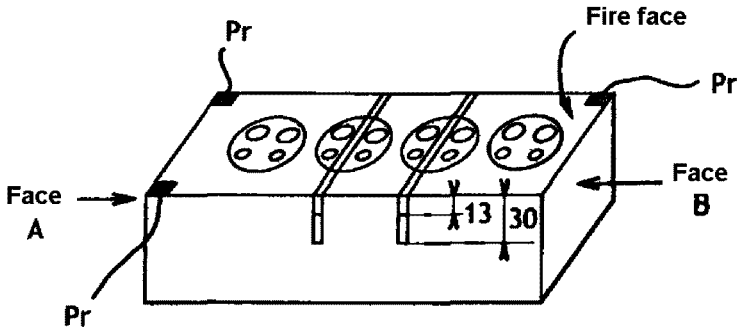
FIG. 3 illustrates the principle for measuring deformations due to relaxation of a cylinder head.

As this is illustrated schematically in FIG. 3, the cylinder heads were gradually sectioned by milling starting from the fire face. The cylinder heads, before being cut, and then at each cutting step, at depths of 13 and 30 mm relatively to the fire face, measured dimensionally in order to quantify the maximum deflection of the cylinder head relatively to the three reference ranges Pr of the fire face, and the variation of the average length of the cylinder head on faces A and B.

The values of the deformations due to relaxation of the cylinder head are thus reported in the Table hereafter; these values representing a qualitative and global measurement of the state of residual stresses of the cylinder head.

| Test | Maximum deflection, fire face (mm) | Average length contraction (A/B) (mm) |
|---|---|---|
| No. 4 | 0.14 | 0.10 |
| No. 5 | 0.15 | 0.26 |
| No. 6 | 0.05 | 0.05 |

It is observed that among these three tests, the treatment according to the invention including air quenching under the operating conditions of the method according to the invention is the only one capable of providing a significant reduction in residual stresses, while retaining a good level of mechanical characteristics. This effect on the residual stresses is probably a discriminating element in the unexpected improvement of the bench behaviors of cylinder heads heat-treated by the method according to the invention.

The invention claimed is:

1. A method for heat treatment of an aluminum alloy casting part comprising:

solution annealing the casting part for a duration ranging from three to ten hours;

quenching the solution annealed casting part, wherein the solution annealed casting part is cooled during quenching from 495° C. to 200° C. in a duration ranging from 3 minutes 30 seconds to less than 7 minutes 30 seconds; and tempering the quenched casting part at a tempering temperature to attain a resistance level of the part at least equal to 85% of a maximum resistance level at the tempering temperature.

2. The method according to claim 1, wherein the solution annealing is performed for a duration ranging from five hours to ten hours.

3. The method according to claim 1, wherein the solution annealing is carried out in a conventional oven.

4. The method according to claim 1, wherein the solution annealing is carried out in a fluidized bed.

5. The method according to claim 1, wherein the solution annealing comprises:

a solution annealing in a fluidized bed for a duration of less than or equal to 30 minutes, wherein the solution annealing is applied upon exiting molding so as to clean the casting part; and then solution annealing the cleaned casting part in a conventional oven.

6. The method according to claim 1, wherein the solution annealing is applied to the casting part after complete cleaning adapted for ridding the casting part of its internal cores, and after removal of the feeder heads and the casting systems.

7. The method according to claim 1, wherein the solution annealing is applied to the casting part upon exiting molding.

8. The method according to claim 1, wherein the quenching is carried out in a fluidized bed at a temperature of less than 40° C.

9. The method according to claim 1, wherein the quenching comprises air quenching, at an air flow rate, a plurality of casting parts positioned in a single layer at room temperature.

10. The method according to claim 9, wherein the air flow rate is greater than or equal to 1,000 $m^3$/h/part.

11. The method according to claim 1, wherein the tempering of the quenched casting part is performed at the tempering temperature to obtain the tensile strength level of the cast part equal to 100% of the maximum tensile strength level for the tempering temperature.

12. The method according to claim 1, wherein the tempering is performed in a conventional oven.

13. The method according to claim 1, wherein the aluminum alloy comprises an AA 319 alloy, and wherein the tempering is performed at 210° C. for 4 hours in a conventional oven.

14. The method according to claim 1, wherein the aluminum alloy comprises an AA 356 alloy and the tempering is performed at 180° C. for 5 hours in a conventional oven.

15. The method according to claim 1, wherein the casting part is a cylinder head.

16. The method of claim 1, wherein the tempered casting part has a fatigue resistance of greater than about 4800 cycles+/−200 cycles evaluated by the hot-cold fatigue resistance test.

17. A method for heat treatment of an aluminum alloy casting part consisting of:

solution annealing the casting part for a duration ranging from three to ten hours;

quenching the solution annealed casting part with air or in a fluidized bed, wherein cooling of the solution annealed casting part is cooled during quenching from 495° C. to 200° C. in a duration ranging from 3 minutes 30 seconds to less than 7 minutes 30 seconds; and tempering the quenched casting part at a tempering temperature to attain a resistance level of the part at least equal to 85% of a maximum resistance level at the tempering temperature.

18. A method for heat treatment of an aluminum alloy casting part comprising:

solution annealing the casting part at a temperature ranging from about 490° C. to about 550° C. for a duration ranging from three to ten hours;

quenching the solution annealed casting part with air or in a fluidized bed, wherein cooling of the solution annealed casting part is cooled during quenching from 495° C. to 200° C. in a duration ranging from 3 minutes 30 seconds to less than 7 minutes 30 seconds; and tempering the quenched casting part at a tempering temperature to attain a resistance level of the part at least equal to 85% of a maximum resistance level at the tempering temperature, wherein the tempered casting part has a fatigue resistance of greater than about 4800 cycles+/−200 cycles evaluated by the hot-cold fatigue resistance test.

* * * * *